US005435861A

United States Patent [19]

Khan et al.

[11] Patent Number: 5,435,861

[45] Date of Patent: Jul. 25, 1995

[54] NICKEL-BASED MONOCRYSTALLINE SUPERALLOY WITH IMPROVED OXIDATION RESISTANCE AND METHOD OF PRODUCTION

[75] Inventors: Tasadduq Khan, Jouy en Josas; Pierre Caron, Les Ulis, both of France

[73] Assignee: Office National d'Etudes et de Recherches Aerospatiales, Chatillon sous Bagneux, France

[21] Appl. No.: 103,172

[22] Filed: Aug. 6, 1993

Related U.S. Application Data

[63] Continuation-in-part of Ser. No. 12,365, Feb. 2, 1993, abandoned.

[30] Foreign Application Priority Data

Feb. 5, 1992 [FR] France ..... 92 01302

[51] Int. Cl.[6] ..... C22C 19/05

[52] U.S. Cl. ..... 148/428; 420/443; 420/448

[58] Field of Search ..... 420/443, 445, 448, 450; 148/428

[56] References Cited

U.S. PATENT DOCUMENTS

| | | | |
|---|---|---|---|
| 4,162,918 | 7/1979 | Huseby | 164/72 |
| 4,240,828 | 12/1980 | Huseby | 164/138 |
| 4,721,540 | 1/1988 | Harris et al. | 420/448 |
| 5,077,141 | 12/1991 | Naik et al. | 420/448 |

FOREIGN PATENT DOCUMENTS

| | | | |
|---|---|---|---|
| 0240451 | 10/1987 | European Pat. Off. . | |
| 0246082 | 11/1987 | European Pat. Off. . | |
| 0395812 | 11/1990 | European Pat. Off. . | |
| 0413439 | 2/1991 | European Pat. Off. . | |
| 57-143462 | 9/1982 | Japan | 420/443 |
| 2194960 | 3/1988 | United Kingdom . | |

*Primary Examiner*—George Wyszomierski
*Attorney, Agent, or Firm*—Armstrong, Westerman, Hattori, McLeland & Naughton

[57] ABSTRACT

A nickel-based monocrystalline superalloy suitable for turbine engine blades is obtained by adding to the alloy at least one element chosen from erbium and silicon, at a concentration by weight of 50 to 500 ppm for Er and of 500 to 1000 ppm for Si and, optionally, hafnium at a concentration by weight of 500 to 1000 ppm.

9 Claims, 2 Drawing Sheets

NICKEL-BASED MONOCRYSTALLINE SUPERALLOY WITH IMPROVED OXIDATION RESISTANCE AND METHOD OF PRODUCTION

This application is a continuation-in-part of application Ser. No. 08/012,365 filed Feb. 2, 1993, now abandoned.

BACKGROUND OF THE INVENTION

The invention relates to nickel-based superalloys suitable for monocrystalline solidification, referred to below as monocrystalline superalloys, useful in particular for manufacturing turbine engine blades.

In practice, the blades of turbines made of superalloys are almost always coated with a layer affording protection against the harmful effects of corrosion and oxidation. However, it is important that the resistance of the uncoated material to the environment should be good, in order to avoid an accelerated degradation of the alloy when the coating is damaged during use.

The increase in gas turbine performance goes hand in hand with increases in temperature and in operation period. This evolution requires, in particular, an improvement of the high temperature oxidation resistance of the existing alloys.

An object of the invention is to improve the high temperature oxidation resistance of various nickel-based monocrystalline superalloys by modifications of their chemical composition, while maintaining the same level of creep resistance.

SUMMARY OF THE INVENTION

This result is obtained according to the invention, surprisingly, by incorporating in the superalloy at least one element chosen from erbium and silicon, at a concentration by weight of 50 to 500 ppm for Er and of 500 to 1000 ppm for Si, and, optionally, hafnium at a concentration by weight of 500 to 1000 ppm.

The invention relates more particularly to alloys whose composition by weight is in the following range, the elements Ni, Er, Si and Hf being omitted :

| | |
|---|---|
| Cr | 6 to 10% |
| Co | 4 to 8% |
| W | 4.8 to 9% |
| Mo | 0 to 2.5% |
| Al | 4.5 to 6.2% |
| Ti | 0 to 2.2% |
| Ta | 3.3 to 9% |
| B | ≦100 ppm |
| C | ≦100 ppm |
| Zr | ≦100 ppm |

The invention also provides a method of producing a superalloy such as defined above, in which the elements Er and/or Si and, if required, Hf are introduced during the manufacture of the master casting of the alloy, or during the re-melting preceding the monocrystalline solidification.

DESCRIPTION OF THE PREFERRED EMBODIMENTS

Figure 1:
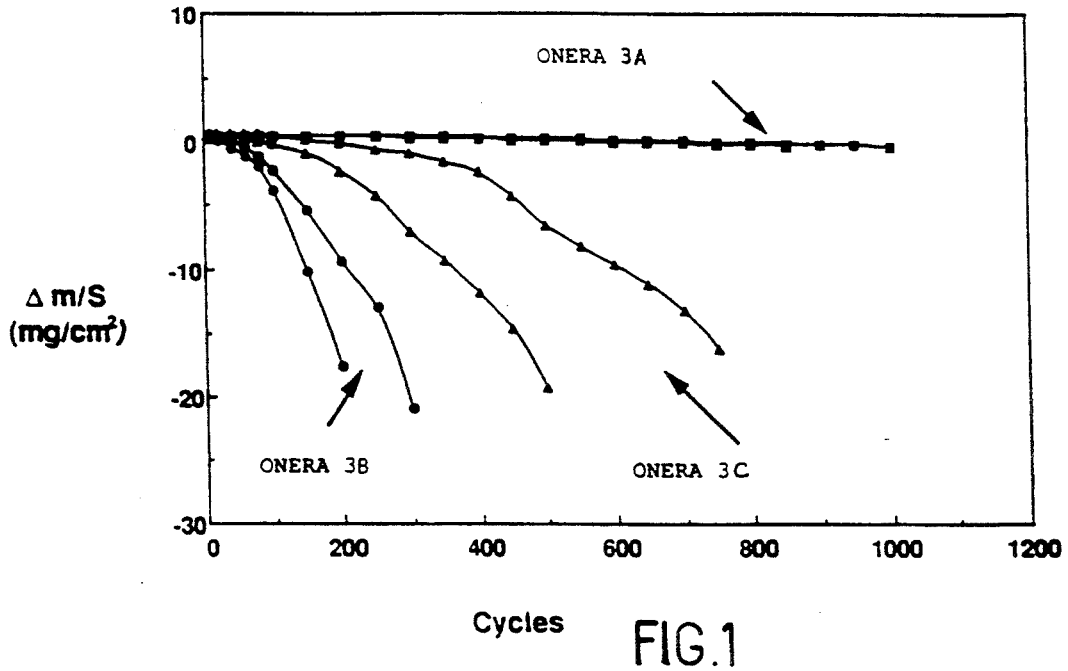
FIGS. 1 to 4 of the drawings are graphs comparing the oxidation resistance when hot of various alloys in accordance with the invention described in the Examples below with alloys of FR-A-2599757 and FR-A-2557598.

Optional advantageous characteristics of the method according to the invention are set out below:

The monocrystalline solidification is followed by the successive heat treatment stages below:

a) dissolution of the $\gamma$, phase by heating at a temperature lying between 1250 and 1350° C., within the heat treatment window of the alloy, for 30 minutes to 4 hours, then air cooling;

b) precipitation of the $\gamma$, phase by heating at a temperature greater than 1000° C.; and c) increasing the fraction by volume of the $\gamma$, phase by heating at a temperature lying between 800 and 900° C. for a period sufficient to obtain a size of $\gamma$, precipitates of the order of 0.5 micrometre.

Stage a) comprises a plateau at approximately 1300° C. for approximately 3 hours, stage b) a plateau at approximately 1050° C. for approximately 16 hours and stage c) a plateau at approximately 850° C. for approximately 24 hours, these latter two plateaux each being followed by air cooling.

Stage a) comprises a plateau at approximately 1300° C. for approximately 3 hours, stage b) a plateau at approximately 1100° C. for approximately 4 hours and stage c) a .plateau at approximately 850° C. for approximately 24 hours, these latter two plateaux each being followed by air cooling.

Stage a) comprises a plateau at approximately 1285° C. for 2 hours followed by a rise to approximately 1295° C. over approximately 1 hour and by a plateau at this latter temperature for approximately 2 hours, stage b) comprises a plateau at approximately 1100° C. for approximately 5 hours and stage c) comprises a plateau at approximately 850° C. for approximately 24 hours, these latter two stages each comprising air cooling.

The invention also provides a turbine engine blade produced from a superalloy, and/or obtained by the method, as defined above.

Other characteristics and advantages of the invention will appear on perusal of the detailed description below and the appended drawings.

EXAMPLE I

This example relates to the improvement of the alloy called ONERA 3, described in FR-A-2 599 757.

The high temperature creep resistance of this ONERA 3 alloy compares favourably with that of the best superalloys known previously, with a significantly lower density, substantially equal to 8.25 g $cm^{-3}$.

Its composition by weight is substantially as follows:

| | |
|---|---|
| Cr | 8.1% |
| Co | 5.5% |
| W | 5.0% |
| Mo | 2.2% |
| Al | 6.1% |
| Ti | 2.0% |
| Ta | 3.4% |
| B | ≦10 ppm |
| Zr | ≦50 ppm |
| Ni | remainder to 100% |

Monocrystals of alloys called ONERA 3A, ONERA 3B and ONERA 3C, derived from the ONERA 3 alloy by means of the addition respectively of 200 to 250 ppm by weight of Er, of 60 to 120 ppm by weight of Er and of 30 to 90 ppm by weight of Er, were manufactured by successive re-meltings followed by directed solidification. Micrographic observations carried out on monocrystals which had not been heat treated show the presence of phases rich in erbium in the interdendritic spaces of the ONERA 3A and ONERA 3B alloys.

After application of a treatment to dissolve the $\gamma_1$ phase at 1300° C., observation of the microstructure of these alloys shows the presence of burns caused by the fusion of the erbium-rich phases. The alloys are then subjected to a first annealing at 1050° C. for 16 hours, then to a second annealing at 850° C. for 24 hours.

Specimens of the ONERA 3A and 3C alloys were tested in cyclic oxidation at 1100° C. in air at the same time as specimens of the ONERA 3 reference alloy.

The thermal oxidation cycle consists of a rise to temperature in 10 minutes, followed by a plateau at 1100° C. for 60 minutes, then a cooling operation in forced air for 3 minutes.

The oxidation kinetics are followed by weighing the specimens every 20 cycles up to 100 cycles, then every 50 cycles up to 1000 cycles.

The results of these oxidation tests are illustrated by the curves in FIG. 1.

The ONERA 3A alloy displays an oxidation resistance which is very substantially improved with respect to that of the ONERA 3 alloy. The ONERA 3C alloy displays an oxidation resistance intermediate between that of the alloy which is the most loaded with erbium, and that of the reference alloy.

This study has made it possible to define an optimal erbium content in the ONERA 3 alloy making it possible to increase substantially the cyclic oxidation resistance at 1100° C. of this alloy, while allowing the total redissolution of the $\gamma_1$ phase without causing the occurrence of burns due to the presence of erbium-rich phases characterised by a low melting point.

One subject of the invention is thus alloys whose composition by weight is defined by the following ranges:

| | |
|---|---|
| Cr | 8.1% |
| Co | 5.5% |
| W | 5.0% |
| Mo | 2.2% |
| Al | 6.1% |
| Ti | 2.0% |
| Ta | 3.4% |
| B | ≦10 ppm |
| Zr | ≦50 ppm |
| Ni | remainder to 100% |

Three alloys, respectively called ONERA 4, ONERA 5 and ONERA 6, whose compositions by weight are indicated in Table 1, were produced by fusion followed by monocrystalline solidification. The ONERA 4 alloy is characterised by an Er content of 100 ppm and corresponds to the specifications detailed below. The ONERA 5 alloy is characterised by an intentional addition of 500 ppm of silicon. The ONERA 6 alloy contains 500 ppm of silicon and 1000 ppm of hafnium.

TABLE 1

| | Concentration by weight in % | | |
|---|---|---|---|
| Element | ONERA 4 | ONERA 5 | ONERA 6 |
| Cr | 8 | 8 | 8 |
| Co | 5.5 | 5.5 | 5.5 |
| W | 5 | 5 | 5 |
| Mo | 2.25 | 2.25 | 2.25 |
| Al | 6 | 6 | 6 |
| Ti | 2 | 2 | 2 |
| Ta | 3.5 | 3.5 | 3.5 |
| B | — | — | — |
| C | — | — | — |
| Zr | — | — | — |
| Er | 0.01 | — | — |
| Si | — | 0.05 | 0.05 |
| Hf | — | — | 0.1 |
| Ni | | Remainder to 100 | |

In Table 1, the symbol "-" indicates the absence of intentional addition of the element in question.

The densities of the ONERA 4, ONERA 5 and ONERA 6 alloys are substantially equal to 8.25 $g.cm^{-3}$.

In the ONERA 4 alloy containing 100 ppm by weight of Er, the gross monocrystalline solidification structure is devoid of erbium-rich interdendritic phases. The application of a high-temperature heat treatment, such as defined above, therefore makes it possible to redissolve entirely the $\gamma_1$ phase particles without causing the occurrence of burns. The additions of Hf and Si to the ONERA 3 alloy lead to a reduction in the heat treatment window. Excessively high Si and Hf concentrations can thus lead to a total disappearance of the heat treatment window, making it then impossible to redissolve the $\gamma_1$ phase particles, which would be prejudicial to the creep resistance of the alloy.

The judicious choice of the concentrations of the elements Si and Hf in the ONERA 5 and ONERA 6 alloys makes it possible to keep heat treatment windows such that it is possible to redissolve the $\gamma_1$ phase totally, or to a very large extent, without risk of burns.

Comparative cyclic oxidation tests at 1100° C. were carried out on the ONERA 3, 4, 5 and 6 alloys after they had been subjected to the heat treatments defined above.

The cyclic oxidation tests were carried out in the following conditions: holding for an hour in air at 1100° C. in a furnace, then keeping outside the furnace for 15 minutes. The specimens are weighed every tenth cycle in order to determine the variations of the mass per unit of surface.

Figure 2:
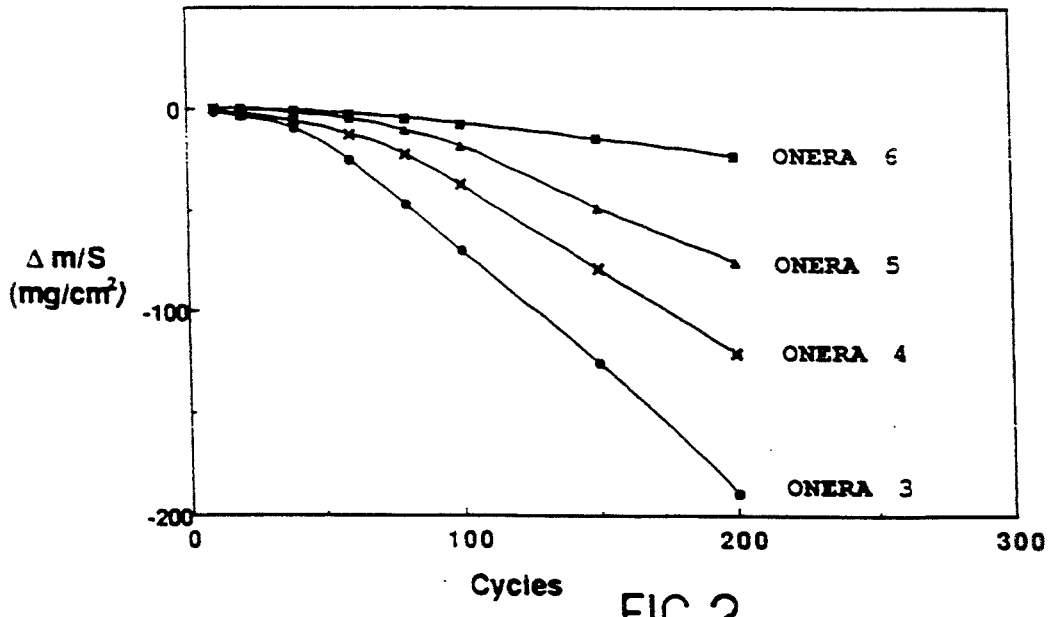

The results of these tests are illustrated by the curves in FIG. 2.

In comparison with the ONERA 3 alloy, these curves show a substantial improvement in the oxidation resistance for the ONERA 4 alloy, a more considerable improvement for the ONERA 5 alloy and a very considerable improvement for the ONERA 6 alloy.

The creep characteristics of the ONERA 4, ONERA 5 ONERA 6 alloys were determined on monocrystals oriented according to <001> which had been subjected to the heat treatments described above, and compared with those of the ONERA 3 alloy which had been subjected to the same treatments.

Table 2 gives, for each alloy and for different temperature and stress conditions, the time necessary to reach a deformation of 1%, and below the latter, the time necessary for rupture.

TABLE 2

| Test conditions | | Creep time (h) | | | |
|---|---|---|---|---|---|
| Temperature (0° C.) | Stress (MPa) | ONERA 3 | ONERA 4 | ONERA 5 | ONERA 6 |
| 760 | 750 | 132 | 193 | 107 | 111 |
| | | 782 | 1212 | 767 | 645 |
| 850 | 500 | 72 | 77 | 103 | 67 |
| | | 248 | 237 | 277 | 254 |
| 1050 | 140 | 206 | 148 | 138 | 256 |
| | | 282 | 278 | 200 | 356 |

These results show that the optimal oxidation resistance at 1100° C. of the ONERA 3 alloy is obtained by joint additions of Hf and Si in proportions such that the microstructure and the creep resistance of the alloy are not modified.

Another subject of the invention is alloys whose composition by weight is defined by the following ranges:

| | |
|---|---|
| Cr | 7.8 to 8.3% |
| Co | 5.0 to 6.0% |
| W | 4.8 to 5.2% |
| Mo | 2.1 to 2.4% |
| Al | 5.8 to 6.1% |
| Ti | 1.8 to 2.2% |
| Ta | 3.3 to 3.7% |
| Si | 500 to 700 ppm |
| Hf | 800 to 1500 ppm |
| B | ≦10 ppm |
| Zr | ≦50 ppm |
| Ni | remainder to 100%. |

EXAMPLE II

The starting point is this time a basic alloy called MC2 whose composition by weight, which is in the range disclosed in FR-A-2 557 598, is as follows:

| | |
|---|---|
| Cr | 8% |
| Co | 5% |
| W | 8% |
| Mo | 2% |
| Al | 5% |
| Ti | 1.5% |
| Ta | 6% |
| Ni | remainder to 100%. |

Two alloys modified by erbium and silicon additions were manufactured by fusion followed by directed solidification in the form of monocrystalline bars having the orientation <001>.

The X alloy contains 800 ppm by weight of erbium and 1300 ppm by weight of silicon. The Y alloy contains 400 ppm by weight of erbium and 550 ppm by weight of silicon.

Analysis of the microstructure of the modified alloys in the untreated monocrystalline state reveals the presence of erbium-rich phases in the interdendritic spaces.

The following heat treatments were applied to the X and Y alloys: hold at 1300° C. for 3 hours, followed by air cooling in order to redissolve $\gamma$, phase precipitates; precipitation treatment at 1100° C. for 4 hours followed by air cooling in order to obtain a uniform distribution of cubic $\gamma$, phase precipitates having a mean size of 400 nm; annealing treatment at 850° C. for 24 hours followed by air cooling in order to increase the fraction by volume of $\gamma$, phase.

After the dissolution treatment at 1300° C., burns are observed in the interdendritic regions of the X alloy, but not in those of the Y alloy.

Specimens of the MC2, X and Y alloys were tested in cyclic oxidation at 1100° C. under the same conditions as those described previously.

Figure 3:
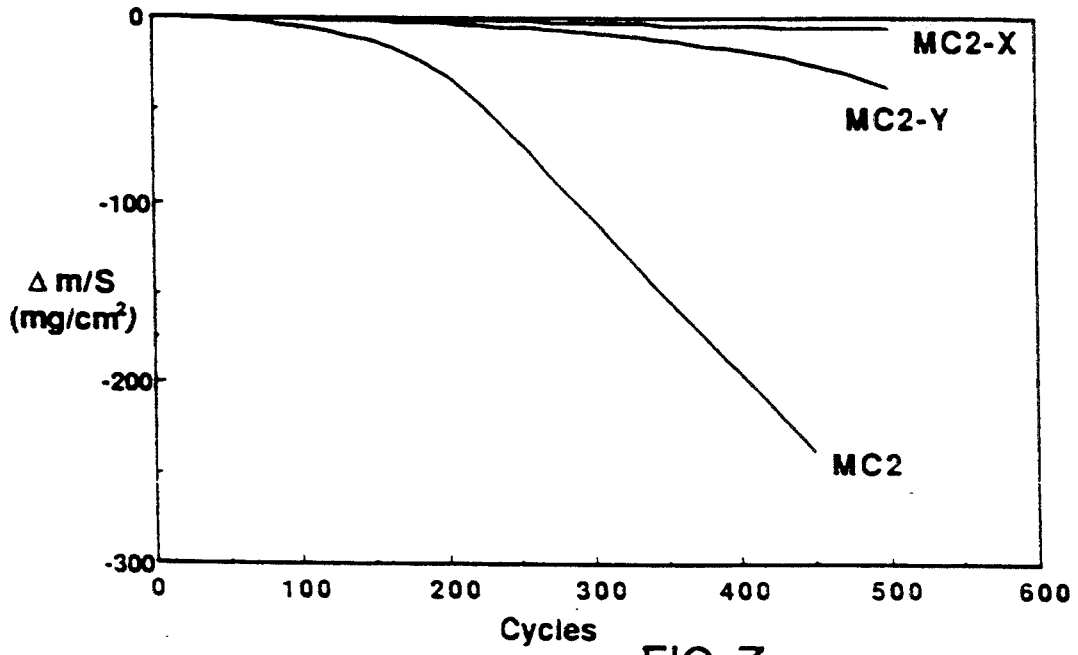

The results of these tests are illustrated by the curves in FIG. 3.

The X and Y alloys display an oxidation resistance which is very substantially improved in comparison with that of the reference alloy.

Creep tests were carried out on test pieces machined from monocrystalline <001> bars made from Y alloy and treated according to the cycle described above. In Table 3, the creep characteristics at different temperatures are compared with those obtained on <001> monocrystals made of MC2 alloy treated in the same conditions. The creep times have the same meaning as in Table 2. Given the dispersions typically observed for this type of alloy, the creep characteristics are comparable for the two alloys in question.

TABLE 3

| Test conditions | | Creep times (h) | |
|---|---|---|---|
| Temperature (0° C.) | Stress (MPa) | MC2 | Y |
| 850 | 500 | 161 | 155 |
| | | 594 | 566 |
| 950 | 240 | 266 | 229 |
| | | 728 | 620 |
| 1050 | 145 | 400 | 398 |
| | | 441 | 472 |

A further subject of the invention is alloys whose composition by weight is defined by the following ranges:

| | |
|---|---|
| Cr | 7.7 to 8.2% |
| Co | 4.8 to 5.4% |
| W | 7.7 to 8.2% |
| Mo | 1.8 to 2.2% |
| Al | 4.85 to 5.1% |
| Ti | 1.3 to 1.6% |
| Ta | 5.8 to 6.2% |
| C | <0.01% |
| Si | 500 to 700 ppm |
| Er | 50 to 400 ppm |
| Ni | remainder to 100%. |

EXAMPLE III

This example relates to an alloy called AM1, also covered by FR-A-2 557 598, and whose composition by weight is as follows:

| | |
|---|---|
| Cr | 7.5% |
| Co | 6.5% |
| W | 5.5% |
| Mo | 2% |
| Al | 5.2% |
| Ti | 1.2% |
| Ta | 8% |
| NI | remainder to 100%. |

A modified alloy containing 980 ppm of silicon and 1000 ppm of hafnium was produced by fusion followed by directed solidification in the form of monocrystalline bars having the orientation <001>.

In the reference alloy, a heat treatment of 3 hours at 1300° C. is commonly used in order to redissolve almost the entire $\gamma$, phase. In the modified alloy, the addition of hafnium and silicon leads to an increase in the fraction by volume of interdendritic eutectic $\gamma$, phase and to a decrease in the solidus temperature of the alloy. Consequently, the application of a heat treatment at 1300° C. leads to the occurrence of burns in the interdendritic regions, resulting from the beginning of melting of the eutectic $\gamma$, phase.

In the case of this modified alloy, a staged treatment was therefore used to dissolve the $\gamma$, phase, consisting of a first heat treatment of 2 hours at 1285° C., followed by a rise in temperature over one hour up to 1295° C., then by a plateau of 2 hours at 1295° C. followed by air cooling. This treatment leads to a redissolution of the $\gamma$, phase comparable with that obtained in the reference alloy after a treatment of 3 hours at 1300° C.

Following the treatments to dissolve the $\gamma$, phase, the monocrystals of the reference alloy and of the modified alloy were subjected to a first annealing at 1100° C. for 5 hours, then to a second annealing at 870° C. for 16 hours, both followed by air cooling.

Figure 4:
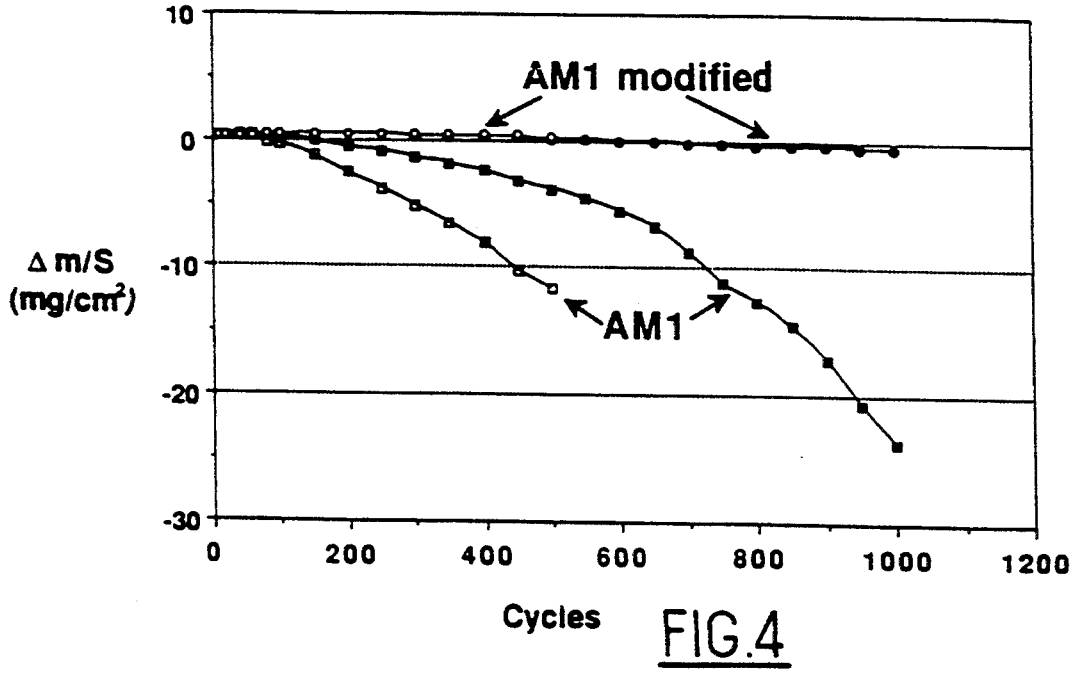

Specimens of the two alloys were tested in cyclic oxidation at 1100° C. The results of these tests are illustrated by the curves in FIG. 4, two of these tests having been intentionally interrupted after approximately 500 cycles in order to examine the specimens.

The modified alloy displays an oxidation resistance which is very substantially improved in comparison with that of the reference alloy.

Creep tests at various temperatures were carried out on test pieces machined from monocrystalline <001> bars of the reference alloy and of the modified alloy, treated according to the procedure described previously. The creep characteristics of these two alloys are collated in Table 4.

TABLE 4

| Test conditions | | Rupture time under creep conditions (h) | |
|---|---|---|---|
| Temperature (°C.) | Stress (MPa) | Reference alloy | Modified alloy |
| 760 | 750 | 582 | 937 |
| 850 | 500 | 326 | 361 |
| 950 | 240 | 450 | 402 |

Given the dispersions typically observed for this type of alloy, the rupture times under creep conditions are comparable for the two alloys in question.

These results show that the heat treatments described last are suitable for alloys according to the invention comprising substantially the following composition by weight:

| | |
|---|---|
| Cr | 7.5% |
| Co | 6.5% |
| W | 5.5% |
| Mo | 2% |
| Al | 5.2% |
| Ti | 1.2% |
| Ta | 8% |
| Si | 1000 ppm |
| Hf | 1000 ppm |
| Ni | remainder to 100%. |

The above examples have no limiting character. Since a substantial improvement in the oxidation resistance was found for basic alloys of three very different compositions within the specified range, there is no reason to suppose that the same does not apply throughout this domain.

We claim:

1. A nickel-based monocrystalline superalloy suitable for producing turbine engine blades, comprising at least one element selected from the group consisting of Er and Si, at a concentration by weight of 50 to 500 ppm for Er and of 500 to 1000 ppm for Si, and having the following composition by weight, wherein the elements Ni, Er and Si are not shown:

| | |
|---|---|
| Cr | 6 to 10% |
| Co | 4 to 8% |
| W | 4.8 to 9% |
| Mo | 0 to 2.5% |
| Al | 4.5 to 6.2% |
| Ti | 0 to 2.2% |
| Ta | 3.3 to 9% |
| B | ≦100 ppm |
| C | ≦100 ppm |
| Zr | ≦100 ppm. |

2. A superalloy according to claim 1, having a composition by weight in the following range:

| | |
|---|---|
| Cr | 7.8 to 8.3% |
| Co | 5.0 to 6.0% |
| W | 4.8 to 5.2% |
| Mo | 2.1 to 2.4% |
| Al | 5.8 to 6.1% |
| Ti | 1.8 to 2.2% |
| Ta | 3.3 to 3.7% |
| Er | 50 to 100 ppm |
| B | ≦10 ppm |
| Zr | ≦50 ppm |
| Ni | remainder to 100%. |

3. A superalloy according to claim 1, having a composition by weight in the following range:

| | |
|---|---|
| Cr | 7.7 to 8.2% |
| Co | 4.8 to 5.4% |
| W | 7.7 to 8.2% |
| Mo | 1.8 to 2.2% |
| Al | 4.85 to 5.1% |
| Ti | 1.3 to 1.6% |
| Ta | 5.8 to 6.2% |
| C | <0.01% |
| Si | 500 to 700 ppm |
| Er | 50 to 400 ppm |
| Ni | remainder to 100%. |

4. A superalloy according to claim 1, having a composition by weight substantially as follows:

| | |
|---|---|
| Cr | 8% |
| Co | 5% |
| W | 8% |
| Mo | 2% |
| Al | 5% |
| Ti | 1.5% |
| Ta | 6% |
| Si | 550% |
| Er | 440 ppm |
| Ni | remainder to 100%. |

5. A turbine engine blade produced from a superalloy according to claim 1.

6. A nickel-based monocrystalline superalloy suitable for producing turbine engine blades, comprising at least one element selected from the group consisting of Er and Si, at a concentration by weight of 50 to 500 ppm for Er and of 500 to 1000 ppm for Si, and having the following composition by weight, wherein the elements Ni, Er and Si are not shown:

| | |
|---|---|
| Cr | 6 to 10% |
| Co | 4 to 8% |
| W | 4.8 to 9% |
| Mo | 0 to 2.5% |
| Al | 4.5 to 6.2% |
| Ti | 0 to 2.2% |
| Ta | 3.3 to 9% |
| Hf | 500 to 1500 ppm |
| B | ≦100 ppm |
| C | ≦100 ppm |
| Zr | ≦100 ppm. |

7. A superalloy according to claim 6, having a composition by weight in the following range:

| | |
|---|---|
| Cr | 7.8 to 8.3% |
| Co | 5.0 to 6.0% |
| W | 4.8 to 5.2% |
| Mo | 2.1 to 2.4% |

-continued

| | |
|---|---|
| Al | 5.8 to 6.1% |
| Ti | 1.8 to 2.2% |
| Ta | 3.3 to 3.7% |
| Si | 500 to 700 ppm |
| Hf | 800 to 1500 ppm |
| B | ≦10 ppm |
| Zr | ≦50 ppm |
| Ni | remainder to 100%. |

8. A superalloy according to claim 6, having a composition by weight substantially as follows:

| | |
|---|---|
| Cr | 7.5% |
| Co | 6.5% |
| W | 5.5% |
| Mo | 2% |
| Al | 5.2% |
| Ti | 1.2% |
| Ta | 8% |
| Si | 1000 ppm |
| Hf | 1000 ppm |
| Ni | remainder to 100%. |

9. A turbine engine blade produced from a superalloy according to claim 6.

* * * * *